United States Patent [19]

Harris

[11] 3,942,192

[45] Mar. 9, 1976

[54] NECKTIE

[75] Inventor: Deane F. Harris, Ferrum, Va.

[73] Assignee: Byrd Industries of Virginia, Inc., Orange, Va.

[22] Filed: Apr. 23, 1975

[21] Appl. No.: 570,944

[52] U.S. Cl. ..... 2/152 R
[51] Int. Cl.[2] ..... A41D 25/08
[58] Field of Search ... 2/144, 148, 149, 150, 152 R, 2/152 A, 153, 156, 137, 145

[56] References Cited

UNITED STATES PATENTS

| | | | |
|---|---|---|---|
| 2,534,669 | 12/1950 | Hall | 2/150 |
| 2,898,600 | 8/1959 | Lipes et al. | 2/150 |
| 3,737,917 | 6/1973 | Orr | 2/150 |
| 3,745,614 | 7/1973 | Tsang | 2/152 X |

*Primary Examiner*—Geo. V. Larkin
*Attorney, Agent, or Firm*—Mason, Fenwick & Lawrence

[57] ABSTRACT

A necktie comprising a rigid, knot supporting means; a first tie portion having a neck embracing loop including lower, inner edges provided with interlockable means; means secured to the knot supporting means and operatively connected to the interlockable means for interlocking and unlocking the interlockable means upon relative movement between the interlockable means and the interlocking and unlocking means to vary the size of the loop; and a second tie portion having an upper end thereof secured to and wrapped around the knot supporting member to form a knot portion, and the remainder thereof depending from the knot supporting member to form a front, depending panel.

22 Claims, 5 Drawing Figures

NECKTIE

The present invention relates to a necktie, and more particularly to a preformed, four-in-hand necktie.

In the prior art, there has been developed a type of preformed, four-in-hand necktie which generally consists of a knot portion, a first tie portion secured to the knot portion and depending therefrom to form a front panel, and a second tie portion passing through the knot portion and having a neck embracing loop. In such a necktie, the lower edges of the neck embracing loop of the second tie portion are provided with interlockable elements similar to the type used in a conventional zipper which cooperate with a interlocking and unlocking member such as the slide fastener of a zipper, when the second tie portion is moved relative to the knot portion, to vary the size of the neck embracing loop. Optionally, the knot portion of such a necktie is provided with a rigid, supporting means which functions to impart a desired configuration to the knot portion, support the interlocking and unlocking means or slide fastener and possibly guide the interlockable elements of the neck embracing loop toward the interlocking and unlocking means. Examples of such type of necktie are disclosed in U.S. Pat. No. 3,127,618, dated Apr. 7, 1964, and U.S. Pat. No. 3,898,698, dated Aug. 12, 1975.

In the aforementioned type of necktie, it has been found that a considerable amount of hand labor is required to manufacture such neckties. Such hand labor, consisting of cutting, sewing and otherwise assembling the components of the necktie, has contributed significantly to the cost of manufacture of such ties. It thus has been found to be desirable to provide a necktie of the type described which requires a minimum amount of hand labor.

Accordingly, it is the principal object of the present invention to provide an improved necktie.

Another object of the present invention is to provide an improved, preformed four-in-hand necktie.

A further object of the present invention is to provide an improved, preformed four-in-hand necktie which not only is feasible to manufacture but is capable of effectively simulating a hand tied, four-in-hand necktie.

A still further object of the present invention is to provide an improved, preformed four-in-hand necktie which requires a minimum amount of hand labor such as cutting, sewing and other assembly operations, to manufacture.

Another object of the present invention is to provide an improved, preformed four-in-hand necktie including a knot portion, a front depending tie portion and a rear, depending tie portion including a loop adapted to fit around the neck of the wearer, having the lower portion thereof passing through the knot portion, wherein the depending tie portion may be passed freely through the knot portion without disturbing the other portions of the necktie.

A further object of the present invention is to provide an improved, preformed four-in-hand necktie which is simple in construction, comparatively inexpensive to manufacture and relatively durable in use.

Other objects and advantages of the present invention will become more apparent to those persons having ordinary skill in the art to which the present invention pertains, from the following description taken in conjunction with the accompanying drawing wherein.

Figure 4:
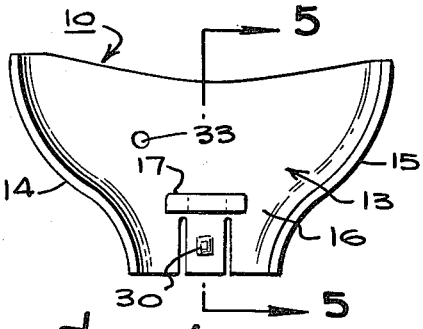
FIG. 4 is a rear view of a knot supporting member, constituting a component of the embodiment illustrated in FIGS. 1 through 3.
Figure 5:
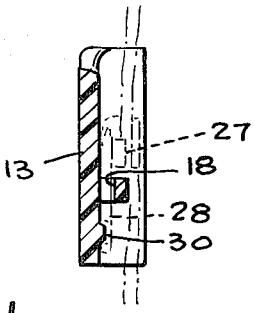
FIG. 5 is a cross-sectional view taken along line 5—5 in FIG. 4.

Referring to the drawing, there is illustrated an embodiment of the invention generally including a rigid, knot supporting member 10, a first tie portion 11 connected to the knot supporting member, and a second tie portion having an upper end thereof secured to and wrapped around the knot supporting member and the first tie portion to form a knot simulating the knot of a conventional, four-in-hand necktie. As best illustrated in FIGS. 4 and 5, knot supporting member 10 consists of any suitable rigid material such a metal or plastic, and includes a planar section 13 having an inverted, substantially trapezoidal configuration, and a pair of converging flanges 14 and 15 formed integrally with the sides of planar section 13. Disposed on the inner surface 16 of planar section 13, intermediate the lower ends of flanges 14 and 15, is a bracket element 17 having a vertical opening 18 therethrough.

Tie portion 11 consists of a pair of narrow strips of fabric material 19 and 20 rigidly secured together at lower, inner edges thereof as at 21 and secured together by stitching or other suitable means at the upper ends thereof as at 22 to provide an upper, neck embracing loop 23, and a conventional zipper 24 secured to the inner edges of the loop. Zipper 24 consists of interlockable elements 25 secured along opposed inner edges of the loop and a slide fastener 26. As best illustrated in FIGS. 1 and 2, the slide fastener includes a camming element 27 through which interlockable elements 25 pass and are cammed together in interlocking relation upon relative movement between the slide fastener and the interlockable elements, and a gripping tab 28 pivotally connected to the camming element and provided with an opening 29.

Figure 2:
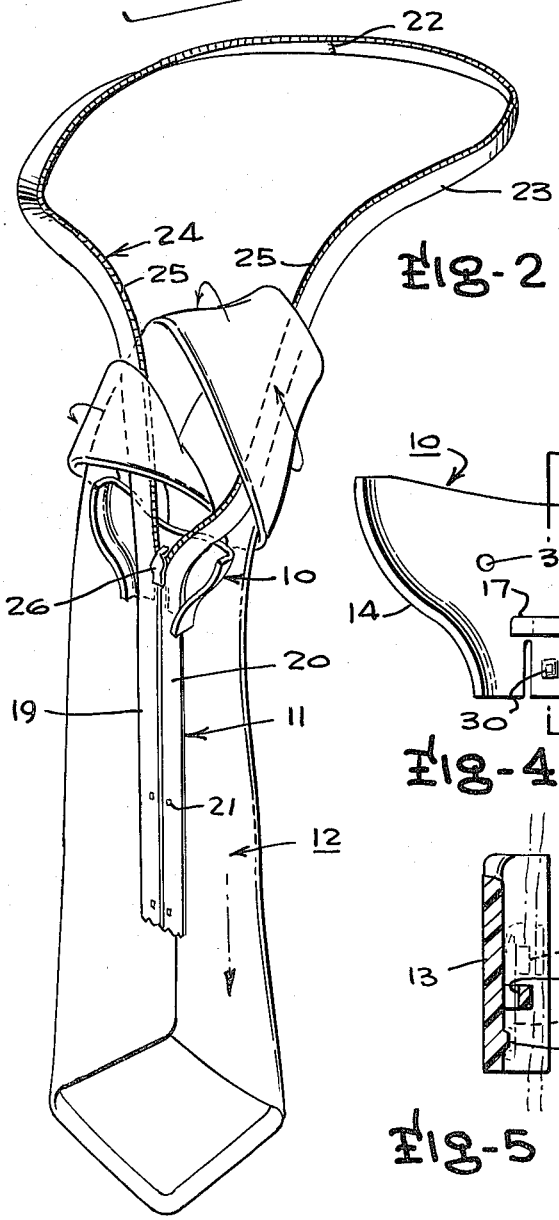
FIG. 2 is a perspective view of the invention shown in FIG. 1, illustrating the components thereof in a partially assembled condition.
Figure 3:
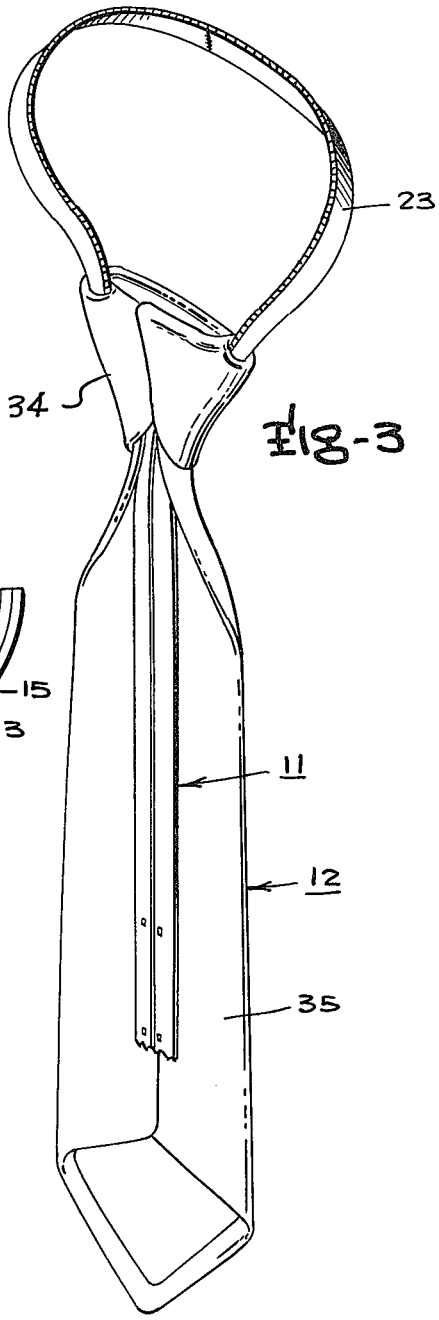
FIG. 3 is a perspective view similar to the view shown in FIG. 2, illustrating the embodiment in the assembled condition.

As best illustrated in FIGS. 2 and 5, the narrow strips of tie portion 11 are adapted to overlie rear face 16 of the knot supporting member, between converging flange portions 14 and 15, and slide fastener 26 is disposed intermediate the side flange portions with gripping tab 28 being received through opening 18 of bracket element 17. The gripping tab is secured within opening 18 by means of a protuberance 30 formed on the rear face 16 of the supporting member and projecting into opening 29 of the gripping tab.

Figure 1:
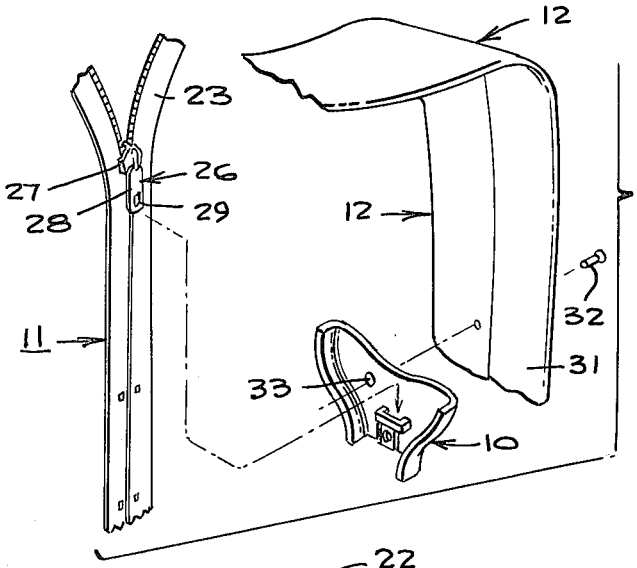
FIG. 1 is a partial, perspective view of an embodiment of the invention, illustrating the components thereof in exploded relation.

Upper end 31 of tie portion 12, illustrated in the inverted position in FIG. 1, is adapted to overlie the front face of supporting member 10 and is fastened thereto by means of a fastening element 32 extending through the tie end 31 and an opening 33 provided on the planar section of the supporting member. Fastening element 32 is a rivet-like element provided with a head portion, which may be inserted through a hole in tie end 31 and opening 33 in the supporting member, and struck on the inserted end to firmly secure the fastener and correspondingly tie end 31 to the front face of the supporting member. As best illustrated in FIG. 2, tie end 31 is wrapped around supporting member 13, passing rearwardly through loop 23, around converging side flange 23, the front side of planar section 13, around converging flange 15, passing forwardly through loop 23 and downwardly between tie end 31 secured to the supporting member and the wrapped around portion thereof, providing a knot portion 34 and a depending front panel 35. Essentially, knot portion 34 and depending front panel 35 are identical to a conventional, tie four-in-hand necktie.

Upon forming tie portions 11 and 12 and supporting member 13, it will be appreciated that the embodiment as described may be assembled simply by positioning tie portion 11 on supporting member 13 with the gripping tab of slide fastener 16 received within opening 18 and secured therein by means of protuberance 30, securing tie end 31 to the front side of the supporting member, wrapping it around the supporting member to form the knot portion 34 and depending front panel 35, and then pulling downwardly on the depending front panel to tighten the knot portion around the supporting member.

In wearing the necktie as described, it is required only to grip the knot portion with one hand and pull the loop of tie portion 11 with the other hand to enlarge the opening of the loop enough to fit over the head of the wearer. The loop is then maneuvered over the head of the wearer and fitted under the shirt collar in the conventional manner. Then, by grasping the lower end of tie portion 11 with one hand, the knot portion may be moved upwardly and fitted under the neck of the wearer. To remove the necktie, it is necessary only to grasp the knot portion of the tie and move it downwardly to enlarge the opening in the loop of the tie. The loop can then be lifted and maneuvered over and off of the head of the wearer.

Although the supporting member has been described as having an inverted, substantially trapezoidal configuration with converging side flanges, it is to be understood that such member can have any suitable configuration. As previously stated, the supporting member may be formed of any rigid material although it has been found most practical that such member be formed of plastic by injection molding. In addition, tie portions 11 and 12 of the necktie may be formed of any material normally used in conventional neckties.

By utilizing the upper end of the tie portion forming the depending front panel of the necktie to form the knot portion, the necessity of cutting, forming and sewing a separate piece of material on the supporting member to form the knot portion is eliminated along with the expense of performing such operation. In addition to reducing the costs of manufacture of the tie, the formation of the knot portion of the necktie by the upper end of the tie portion forming the depending front panel of the necktie simulates a conventional, hand tied, four-in-hand necktie thus enhancing the aesthetics of the necktie.

From the foregoing detailed description, it will be evident that there are a number of changes, adaptations and modifications of the present invention which come within the province of those skilled in the art. However, it is intended that all such variations not departing from the spirit of the invention be considered as within the scope thereof and is limited solely by the appended claims.

I claim:

1. A necktie comprising a rigid, knot supporting means; a first tie portion having a neck embracing loop including lower, inner edges provided with inverlockable means; means secured to said knot supporting means and operatively connected to said interlockable means for interlocking and unlocking said interlockable means upon relative movement between said interlockable means and said interlocking and unlocking means to vary the size of said loop; and a second tie portion having an upper end thereof secured to said knot supporting means and wrapped around said knot supporting member to form a knot portion, and the remainder thereof depending from said knot supporting member to form a front, depending panel.

2. A necktie according to claim 1 wherein said knot supporting means includes means for guiding said interlockable means together.

3. A necktie according to claim 2 wherein said interlocking and locking means is disposed between said guide means.

4. A necktie according to claim 1 wherein said knot supporting means comprises a plate member having converging side edges providing a converging configuration to said knot portion.

5. A necktie according to claim 4 wherein said plate member includes opposed, converging side flanges, and said interlocking and locking means are secured to said plate member between said converging side flanges.

6. A necktie according to claim 1 wherein said second tie portion is formed of a fabric material.

7. A necktie according to claim 1 wherein said second tie portion includes an upper end portion secured to a front side of said knot supporting means, passing rearwardly through said neck embracing loop, wrapping about the front side of said knot supporting means, passing forwardly through said neck embracing loop, thus forming a knot portion on said knot supporting means, passing downwardly between the front side of said knot supporting means and the portion thereof wrapped around the front side of said knot supporting means, providing said knot portion, and depends from said knot portion to provide a front panel.

8. A necktie according to claim 7 wherein said knot supporting means includes means for guiding said interlockable means together.

9. A necktie according to claim 8 wherein said interlocking and locking means is disposed between said guide means.

10. A necktie according to claim 8 wherein said second tie portion is formed of a fabric material.

11. A necktie according to claim 8 wherein said knot supporting member comprises a plate member having converging side edges providing a converging configuration to said knot portion.

12. A necktie according to claim 11 wherein said plate member includes opposed, converging side edges, and said interlocking and unlocking means is secured to said plate member between said converging side flanges.

13. A necktie according to claim 8 wherein said interlockable means comprises interlocking elements of a zipper and said interlocking and unlocking means comprising a slide fastener of a zipper.

14. A necktie according to claim 13 wherein said second tie portion is formed of a fabric material.

15. A necktie according to claim 13 wherein said knot supporting means comprises a plate member having converging side flanges providing a channel, and said plate member includes means defining a socket disposed between said converging flanges, and wherein said slide fastener includes a gripping tab received and locked within said socket whereby upon relative movement between said knot portion and said first tie portion including said neck embracing loop, the section of said first tie portion passing through the opening of said knot portion will engage inner surfaces of said converging side flanges to guide said interlocking elements thereof toward said slide fastener.

16. A necktie according to claim 13 wherein said knot supporting means includes means for guiding said interlocking elements toward said slide fastener.

17. A necktie according to claim 16 wherein said slide fastener is disposed between said guide means.

18. A necktie according to claim 17 wherein said knot supporting means comprises a plate member having converging side edges providing a converging configuration to said knot portion.

19. A necktie according to claim 18 wherein said plate means includes opposed, converging side flanges, and said slide fastener is secured to said plate member between said converging side flanges.

20. A necktie according to claim 13 wherein said slide fastener includes a gripping tab secured to said knot supporting means.

21. A necktie according to claim 20 wherein said knot supporting means includes an opening receiving and locking said gripping tab.

22. A necktie according to claim 21 wherein said gripping tab includes an opening, and said knot supporting means includes a protuberance extending into the opening of said gripping tab for locking the gripping tab within said socket and correspondingly securing said slide fastener to said knot supporting means.

* * * * *